United States Patent [19]

Pohl

[11] Patent Number: 4,688,872

[45] Date of Patent: Aug. 25, 1987

[54] ELECTRICAL CONNECTOR MODULE WITH MULTIPLE CONNECTOR HOUSINGS

[75] Inventor: Karl H. Pohl, Buffalo, Minn.

[73] Assignee: ADC Telecommunications, Inc., Minneapolis, Minn.

[21] Appl. No.: 891,406

[22] Filed: Jul. 28, 1986

Related U.S. Application Data

[63] Continuation of Ser. No. 658,268, Oct. 5, 1984, abandoned, which is a continuation-in-part of Ser. No. 637,146, Aug. 2, 1984, abandoned.

[51] Int. Cl.[4] ..... H01R 4/24

[52] U.S. Cl. ..... 439/404; 439/399; 439/721

[58] Field of Search ..... 339/97 R, 97 P, 98, 339/99 R, 198 R

[56] References Cited

U.S. PATENT DOCUMENTS

| | | | |
|---|---|---|---|
| Re. 31,132 | 1/1983 | Hoppe, Jr. . | |
| 2,537,820 | 1/1951 | Flood . | |
| 2,983,892 | 5/1961 | Williams et al. . | |
| 2,991,444 | 7/1961 | Brereton | 339/198 R |
| 3,045,204 | 7/1962 | Cassella | 339/198 R |
| 3,181,107 | 4/1965 | Garber et al. . | |
| 3,299,393 | 1/1967 | Kelley et al. . | |
| 3,514,743 | 5/1970 | Schantz . | |
| 3,543,219 | 11/1970 | Pautrie . | |
| 3,643,205 | 2/1972 | Elkins . | |
| 3,697,669 | 10/1972 | O'Loughlin et al. . | |
| 3,708,852 | 1/1973 | Mason . | |
| 3,772,635 | 11/1973 | Frey et al. . | |

(List continued on next page.)

FOREIGN PATENT DOCUMENTS

| | | |
|---|---|---|
| 1434003 | 4/1976 | United Kingdom . |
| 2004425 | 3/1979 | United Kingdom . |

OTHER PUBLICATIONS

"Telco Terminals—The Search Goes On", *Telephone Engineer & Management*, Apr. 15, 1983.

Watson and Vachhani, "QCP: The Latest Frame Wiring Method for Telcos", *Telephony*, Nov. 15, 1982.

TRW Cinch Connectors C-197, TRW Inc., Sep. 1977, brochure.

"Guidelines—Plug Cross-Connect Bays", Bell Laboratories, Jun. 1976, p. 13.

"The Denver Plan—CCB: A Method of Reducing Central Office Bulge", Bunker Ramo Amphenol, date unknown.

"QCP Wire Distribution Systems", sales brochure, Magnetic Controls Co., Jul. 1984.

"QCP: The Circuit Concentration System for Tomorrow's World of Communications", sales brochure, Magnetic Controls Co., Jan. 1983.

*Primary Examiner*—Joseph H. McGlynn

*Attorney, Agent, or Firm*—Merchant, Gould, Smith, Edell, Welter & Schmidt

[57] ABSTRACT

An electrical connector module having flexible sidewall bridges and sidewall shoulders for snap mounting the module in a panel, a tool for inserting wires in the module and a connector panel mount is disclosed. The module is formed from a plurality of subhousings arranged in two rows with each subhousing supporting a split cylinder concentrically therein. The subhousings include diametrically opposed slots with one wire engaging lipped slot aligned with the slot in the split cylinder and the other slot aligned with a cutting blade provided on the split cylinder diametrically opposed to the split cylinder slot. Each of the subhousing slots are aligned transversely to the rows and paralled with one another such that a series of wires may be laid side by side in parallel in the subhousing slots over the split cylinder for insertion by a tool in another series of operations. The housings are snap mounted in a panel member which includes an aperture sized to receive the housing. A bracket demountably supports the panel member in a spaced relationship with a supporting surface. The tool includes a central post member sized to fit inside the split cylinders and a concentric outer member sized to fit around the outside of the cylinder and inside the subhousings, and further includes a shoulder member for abuting against the end of the subhousing when fully inserted therein.

15 Claims, 10 Drawing Figures

U.S. PATENT DOCUMENTS 3,778,750 12/1973 Caveney et al. .
3,845,455 10/1974 Shoemaker .
3,860,318 1/1975 Reavis, Jr. et al. .
3,864,003 2/1975 Boke ..... 339/198 R
3,877,773 4/1975 Doty et al. .
3,897,993 8/1975 Fleischhacker et al. .
3,955,873 5/1976 Peterson .
3,964,816 6/1976 Narozny .
3,976,350 8/1976 Keglewitsch ..... 339/97 P
4,045,111 8/1977 Peterson .
4,084,877 4/1978 Knickerbocker ..... 339/97 P
4,118,096 10/1978 Takahashi .
4,118,103 10/1978 Leidy et al. .
4,130,336 12/1978 Dozier .
4,141,618 2/1979 Reavis, Jr. et al. .
4,150,867 4/1979 Knickerbocker .
4,159,158 6/1979 Weidler .
4,160,574 7/1979 DeRoss .
4,161,061 7/1979 Mason et al. .
4,163,596 8/1979 Aysta et al. .
4,168,873 9/1979 Luna .
4,171,858 10/1979 Knowles et al. .
4,183,607 1/1980 Hughes .
4,186,984 2/1980 Reavis et al. .
4,202,589 5/1980 Reavis, Jr. et al. .
4,210,379 7/1980 Vachhani et al. .
4,236,778 12/1980 Hughes et al. .
4,241,496 12/1980 Gregson .
4,241,970 12/1980 Rider, Jr. et al. .
4,255,009 3/1981 Clark .
4,261,629 4/1981 Reynolds et al. .
4,261,633 4/1981 Abernethy ..... 339/97 P
4,262,984 4/1981 Takahashi .
4,283,105 8/1981 Ferrill et al. .
4,286,836 9/1981 Rumps .
4,305,635 12/1981 Navarro .
4,391,484 7/1983 Foederer .

FIG. 1
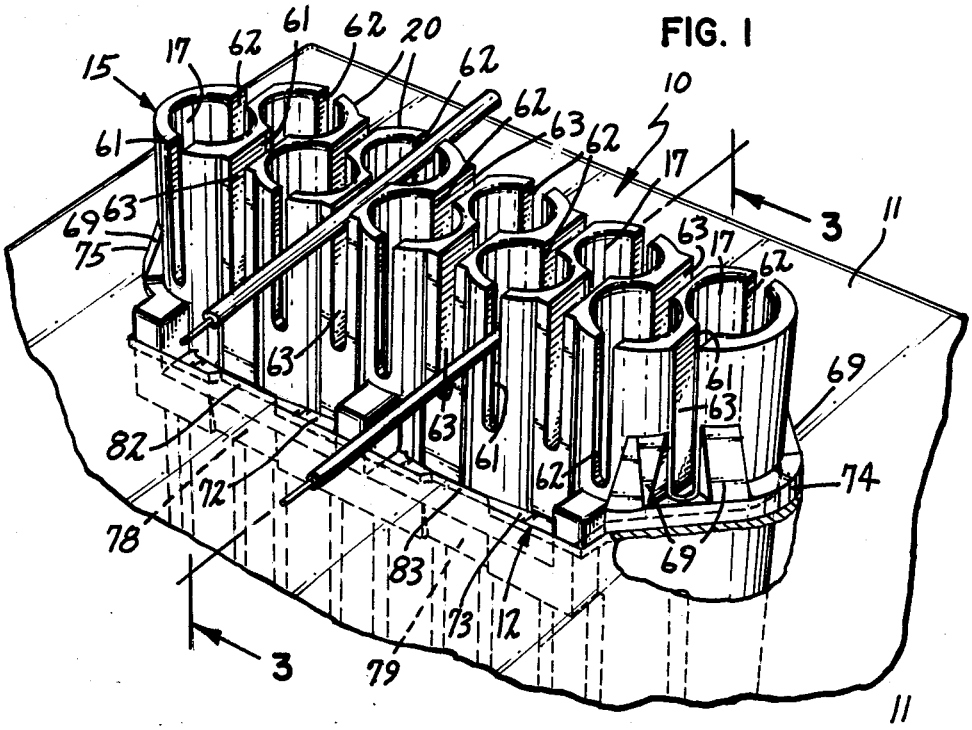
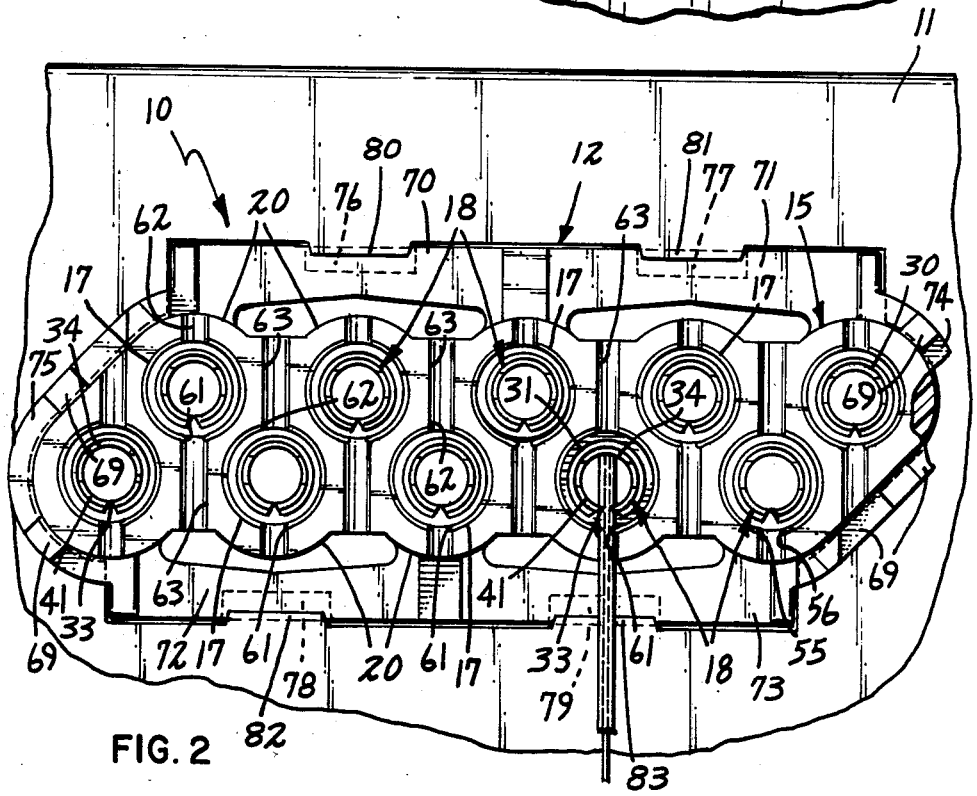
FIG. 2

FIG. 3
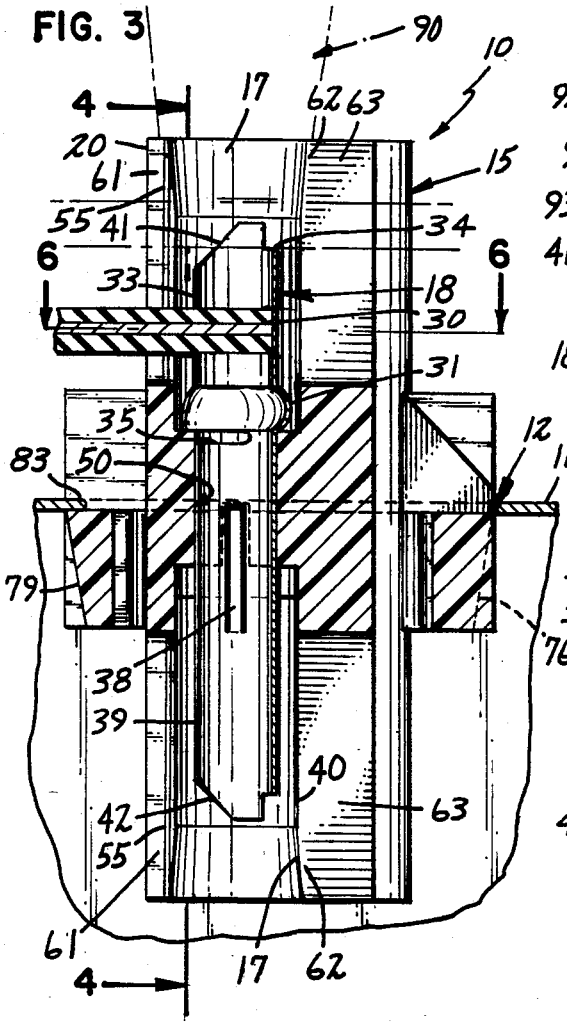
FIG. 4
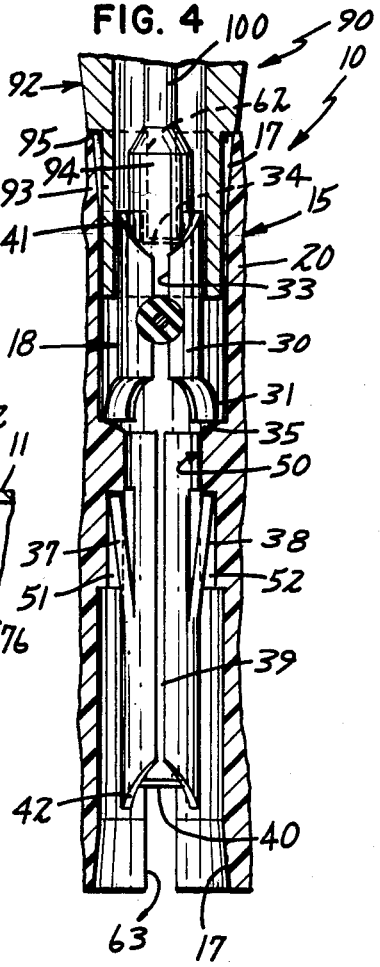
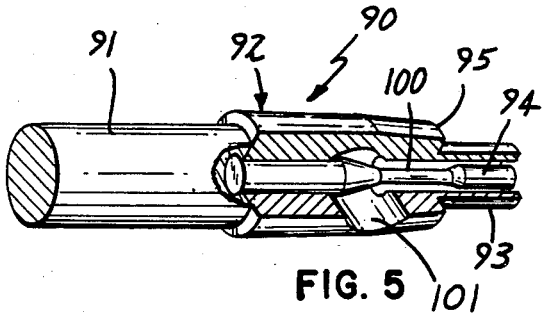
FIG. 5

ELECTRICAL CONNECTOR MODULE WITH MULTIPLE CONNECTOR HOUSINGS

This is a continuation-in-part, continuation of application Ser. No. 658,268 filed 10/5/84, now abandoned, which is a continuation-in part of Ser. No. 637,146, filed Aug. 2, 1984, now abandoned and entitled "Electrical Connector Module with Multiple Connector Housings".

TECHNICAL FIELD OF THE INVENTION

The present invention pertains generally to the field of telecommunications, and more particularly to terminal connecting blocks or panels for the solderless connection of wires.

BACKGROUND OF THE INVENTION

Terminal connecting blocks, modules or panels are widely used in the telecommunications industry to interconnect equipment and distribution lines, particularly in signal switching or distribution applications. The present invention is concerned with connecting modules or panels which provide for a quick, mechanically secure and electrically sound solderless connection, and easy disconnection, of two or more wires. To this end, prior art connecting modules make unnecessary most pre-connection and post-connection wire conditioning, such as stripping, bending and trimming, and employ insulation displacement or like wire connection methods in which the module terminal exerts a positive grip on an installed wire conductor.

U.S patent application Ser. No. 321,107 by Vachhani, filed Nov. 13, 1981, entitled "Electrical Connector Module", now abandoned, continuation filed Sept. 13, 1984 as Ser. No. 650,252, discloses insulation displacement connecting module which provides for quick, mechanically secure and electrically sound solderless connections The Vachhani device employs a metal split cylinder having an axially extending narrow seam or slot in which a wire may be conected by moving it laterally of its axis into the slot. The edges of the slot slic through the insulation and establish an electrical and mechanical contact with the conductor with a positive gripping force as provided by the resilience of the cylinder cross section. The cylinder is supported in an insulating housing of generally cylindrical shape with a rectangular crosssection, in a coaxial orientation, to form a connector module. The housing is slotted along diagonally opposite corners and the cylinder aligned therein such that one corner slot is aligned with the wire receiving slot in the cylinder. A plurality of modules are individually mounted to extend orthogonally from a planar member to form a multiple connector terminal connecting panel. Installation of a wire in a module is accomplished by laying it to extend through the housing slots, over the cylinder, and using an impact tool to drive the wire down into the split cylinder, which preferably includes a cutting edge opposite the wire receiving slot to trim or sever the excess wire length. An installed wire is thus shielded from others by the housing such that shorting and interference problems are avoided.

Although the Vachhani panel provides for the quick and secure solderless cross connection of a large number of wires at a central location with relatively high density, it does have certain disadvantages. For one, assembly of the panel requires that individual modules be mounted one at a time, such that assembly is time consuming and correspondingly expensive. For another, the diagonal orientation of the wire slots together with the side by side orientation of the housings generally requires that wires be positioned and installed one at a time, such that the installer must continually switch between positioning and inserting operations, which is time inefficient in the consecutive installation of large numbers of wires. In addition, the Vachhani tool needs to be oriented with respect to a housing for proper operation. Finally, the tool includes moving parts and is thus relatively expensive.

SUMMARY OF THE INVENTION

The present invention provides an insulation displacement electrical connector panel and a tool for installing or inserting wires in the panel which alleviates or eliminates the above described disadvantages of the Vachhani apparatus. According to one aspect of the invention a plurality of metal split cylinders of the above described type are provided and mounted in a non-conductive housing to form a connector module. The housing is formed to support the split cylinders in a plurality of cylindrical subhousings formed in two rows, with each of the subhousings including slots on diametrically opposed sides with one of the subhousing slots coaxially extending with the slot in the split cylinder, and with the subhousing slots aligned transversely to the rows. The subhousings in each row are laterally spaced apart to form a plurality of intersubhousing slots and the subhousings in different rows are laterally offset so that one slot of each subhousing is aligned with one of the inter subhousing slots. According to this aspect of the invention a plurality of wires to be installed may be laid side by side and parallel in the subhousing slots in one series of operations, and installed in another series of operations, eliminating the need to switch back and forth between wire placement and insertion operations where two or more wires are to be installed in the panel sequentially.

According to another aspect of the invention the module housing includes a snap mounting arrangement comprising one or more flexible bridges and shoulders disposed on the side of the housing and longitudinally spaced apart. The bridges include a bridge member spaced apart from the side of the housing and supported on opposite ends so that it may flex toward the housing when compressed. The panel member provided for supporting the housing includes an aperture sized to receive the housing with the aperture including one or more tabs positioned to engage the bridge or bridges and compress them inwardly as the housing is slid into the aperture, and to engage a transverse edge of the bridges when the housing is mounted. A shoulder is provided to stop the housing in the mounting position such that the housing is snapped into place and immovably retained by the shoulders on one side of the housing and the transverse edge of the bridges of the other. Thus, the present invention provides for the mounting of a plurality of connectors to a panel simultaneously, as opposed to mounting single connector modules one at a time, thus resulting in substantial time savings in panel assembly.

According to yet another aspect of the invention the housing is constructed of a relatively rigid plastic nonconducting material, and a simple wire insertion or installation tool with no moving parts is provided to insert wires. The wire insertion tool includes a central post sized to fit inside the split cylinder and a cylindrical member coaxially extending around the post and sized to fit around the outside perimeter of the cylinder between the cylinder and the housing. A shoulder is provided on the tool and is axially displaced from the tip, the shoulder being of sufficient radius to engage the end transverse edges of a subhousing with the tip of the tool extending in and around the split cylinder mounted therein. Thus, wires to be installed may be laid across the top of the cylinder extending through the subhousing slots and pressed into the cylinder with the tool, which by virtue is its cylindrical configuration does not need to be oriented, and which does not include moving parts. Furthermore, the operation of the tool provides that the subhousing absorbs certain stresses from the tool as the wire is being inserted to avoid deformation of the split cylinder.

According to still another aspect of the invention the end portions of each subhousing cylinder are funnel shaped to facilitate insertion of the tool into the ends of the subhousings, and to guide the tool into proper axial orientation with the split cylinder. In addition, at least one slot of each subhousing includes arcuate axially extending lips on each side of the slot, with the width of the passageway formed between the lips being slightly less than the diameter of a wire to be installed, so that the lips provide a mechanical grip and strain relief for the wire during and after installation.

According to yet another aspect of the invention of the multiple-connector modules are substantially symmetrical to provide for the connection of wires on either end, and to provide an electrical connection between wires connected on opposite ends. The modules may be mounted to a panel member with one end of the module on either side thereof to form a connector panel. Accordingly, wires may be connected to the modules on either side of the panel with the same tool. Still further, a bracket may be provided for demountably supporting the panel member in a spaced relationship with a bracket mounting surface. Preferably, the bracket is an industry standard 89 bracket and the panel member is sized to mount thereto.

Thus, the present invention provides an electrical connector panel eliminating or alleviating the problems above-discussed with respect to the Vachhani apparatus. More specific details, aspects and salient features of the construction and operation of the invention are set forth in the ensuing drawing and specification.

BRIEF DESCRIPTION OF THE DRAWING

FIG. 1 is a perspective view of a connector module according to the present invention;

FIG. 2 is a top plan view of the electrical connector module according to the present invention;

FIG. 3 is a cross sectional view of the connector module according to the present invention taken along the lines 3—3 of FIG. 1;

FIG. 4 is a cross sectional view of a portion of the connector module according to the present invention taken along the lines 4—4 showing the installation tool according to the present invention inserted therein; and FIG. 5 is a cutaway perspective view of the installation tool according to the present invention;

DETAILED DESCRIPTION OF THE INVENTION

Figure 6:
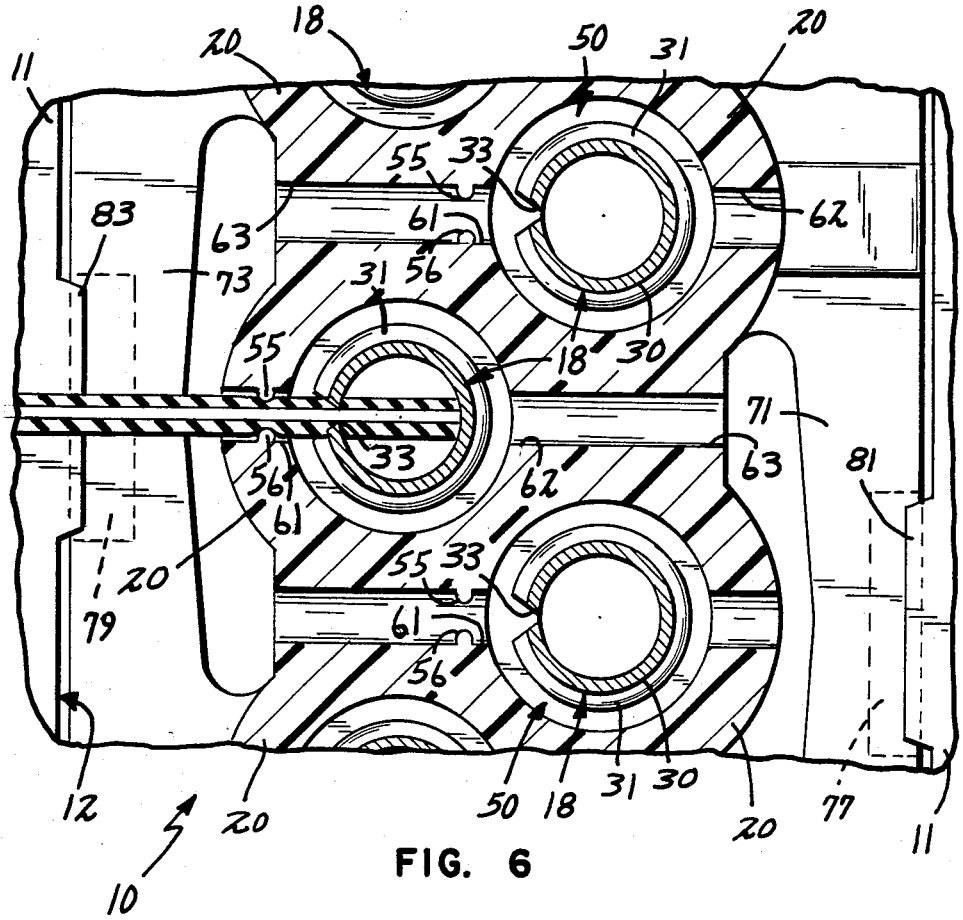
FIG. 6 is a cross sectional view of the connector module of the present invention taken along the lines 6—6 of FIG. 3.

The electrical connector apparatus of the present invention is provided for use in an access member such as the quick-cross connect panel or in a terminal block to electrically connect various electrical lead wires or circuits with certain other electrical lead wires or circuits. In actual practice, the lead wires may be part of a communication circuit such as a telephone line or a data transmission circuit. Where the leads are telephone lines, the electrical connector module of the present invention is utilized to patch or cross-connect such lines to accommodate growth of telephone usage, changes in telephone number, relocation of users, etc.

Referring to FIGS. 1 and 2 a double-ended insulation displacement connector module according to the present invention is illustrated, in perspective and plan views. Connector module 10 is mounted to a relatively flat panel member 11, in an aperture 12 of generally the same cross-section as connector module 10. Module 10 includes a housing 15 molded of a relatively rigid non-conductive plastic. Housing 15 includes a plurality of generally cylindrical subhousings 20, extending on either side from panel member 11 (see FIG. 3), each of which supports a centrally positioned split cylinder connector member 18. Each of subhousings 20 are formed to include funnel shaped end portions 17 as may be seen best with reference to FIGS. 3 and 4, to facilitate entry and alignment of an insertion tool, as will be described in more detail below. Although partially asymmetrical in certain detail, the module is identical on each side of the panel member with respect to the function and construction of the operative portions of subhousings 20.

With reference to FIGS. 3 and 4 it may be seen that connector member 18 includes a first end 30 including a collar 31, a wire engaging slot 33 and a wire trimming edge or blade 34. The other end of connector member 18 includes a pair of tine members 37 and 38 cut from the sidewalls of the cylinder, a wire engaging slot 39 and a further trimming blade 40. Each end of connector member 18 further includes wire guide sections 41 and 42 narrowing toward the respective slots 33 and 39. A transverse cut 35 structurally isolates the cross sectional resilience of the opposite ends.

To accomodate the mounting of a connector member 18 in the cylindrical subhousing 20, the housing includes an annular retaining portion 50 extending inward from the sidewall of subhousing 20 and having a radius slightly smaller than that of connector member 18. A pair of diametrically opposed and longitudinally extending grooves 51 and 52, having a width slightly larger than that of tines 37 and 38 respectively, are provided in retaining portion 50. The mounting of connector member 18 may thus be accomplished by inserting the member tine-end first into the subhousing such that tines 37 and 38 are compressed as they pass through the upper portion of retaining portion 50, and snap into place in grooves 51 and 52. Connector member 18 is thus axially retained in place by shoulder member 31 on one side of retaining portion 50 and by tines 37 and 38 on the other side, which also provide rotational restriction. A connector is thus positioned in a subhousing 20 to provide functionally identical wire engaging slots on both ends, and both sides of panel member 11.

As may be seen best with reference to FIG. 1, both ends of subhousings 20 include a pair of diametrically opposed axially extending slots 61 and 62 in the cylinder walls with one of the slots on each end aligned with one of slots 33 or 39 and the other slots on each end aligned with the recesses formed by trimming blades 34 or 40. Preferably, the subhousing slots and connector member slots coextend for a minimum of two or three diameters of the wire size to be connected, such that two or three wires may be connected to connector member 18 on either end thereof, as explained below. Further inter subhousing slots 63 are provided, coaxially extending with associated cylinder wall slots 61 or 62.

As shown best in FIG. 6, slots 61, 62 and 63 have generally the same width, which is slightly greater then the diameter of the wire to be installed, so as to not engage the wire during installation. Slots 61, however, are preferably formed to include relatively thin arcuate axially extending lips 55 and 56 along each opposite edge, with the width of the opening between the lips 55 and 56 being slightly less than the diameter of a wire to be installed, such that when a wire is inserted transverse to its axis it is gripped by the slot 61, thereby providing a mechanical strain relief for a wire. Although the invention is not limited to specific dimensions, it provides a slot (61, 62, 63) width of 0.045", an inter lip opening width of 0.025", and a lip radius of 0.010" for 0.032" to 0.035" insulated wire. These relative ratios of dimensions have been found to permit wires to be relatively easily manually pulled or pressed in between the lips without undue force during preliminary placement, and to avoid deformation or weakening of the conductor during installation. Moreover, the arrangement provides that the wire may slide downward between the lips via the force applied by the insertion tool, which force is applied on only the portion of the wire lying inside the subhousing. It shall be noted that slots 61, 62 and 63 are identical for a particular end of a housing 15 so that all strain relief slots 61 are on a common side of the subhousings 20.

Housing 15 includes four flexible bridge members 70–73 and a pair of shoulders 74 and 75 to accommodate snap-in mounting of housing 15 in aperture 12 of panel 11. Reinforcement wedges 69 may be provided integral with housing 15 to add to the structural strength of the end subhousings. Each of bridges 70–73 is supported in a spaced apart relationship with the main body of housing 15 and includes a respective ramping portion 76–79, the cross section of which may be best seen in FIG. 3. Four corresponding tab members 80–83 are provided on the panel member 11 to extend into aperture 12. Installation of housing 15 in panel 11 is thus accomplished by inserting the unshouldered end of housing 15 into aperture 12, such that ramps 76–79 engage the respective tabs 80–83 and compress the bridge members 70–73 as the housing 15 is pushed down into the aperture 12, with tabs 80–83 snapping over the top edge of the bridge members as shoulder members 74 and 75 engage panel member 11. Housing 15 is thus irremovably retained in a mounted position on panel member 11.

The tool provided for and the method for installing wires in a connector member 18 will now be explained with particular reference to FIGS. 3, 4 and 5. In FIG. 5, the wire installing tool according to the present invention is shown in cutaway perspective view. The tool 90 includes a shaft 91 to be connected to a handle (not shown), for example a conventional screwdriver handle. The end of shaft 91 includes a tip portion 92 including a cylindrical member 93 having an outside diameter smaller than the inside diameter of the extent of a subhousing 20 surrounding the connector member 18, and an inside diameter slightly greater than the outside diameter of a connecting member 18. A center post or punch member 94 is concentrically disposed within cylindrical member 93, and has a radius slightly smaller than the inside diameter of the connector member 18. Punch member 94 includes a smaller diameter portion 100 which is spaced axially apart from the end of punch member 94 so that when the tool is fully inserted the smaller diameter portion is axially beyond the end of connector member 18. A bored aperature 101 is provided and extends from the inside of tool 90 to the outside of both sides of tip 92. The arrangement of smaller diameter portion 100 and aperture 101 facilitates the movement of plastic and metal residue produced by wire trimming up between members 94 and 95 out of aperture 101, so that the tool does not jam with residue. Member 93 further includes a shoulder 95 of generally the same outside diameter of a subhousing 20, such that when the tool is inserted into a subhousing the shoulder rests on the end edges thereof, and such that the tip 92 of the tool extends downwardly inside and around a connector member 18.

Installation of wires and connectors 18 may be accomplished using tool 90 as follows. As for example shown in FIG. 1, a wire to be installed may be layed in slots 61, 62 and 63 (leftmost wire), and manually pulled down across the top of connecting member 18 (rightmost wire) with the excess wire extending outwardly from the slot adjacent the trimming blade 34 or 40, as determined by which end of housing 15 the wire is installed in. It will be noticed that for any given side of housing 15 that each connector member 18 is aligned with its wire receiving slot facing in the same direction such that wires to be installed are all layed in with the excess wire extending from the same face of the housing. As explained above, each of lipped slots 61 provide a wire restriction which is preferably slightly less wide than the outside diameter of the insulation on a wire to be installed. Thus, a wire may be manually positioned for insertion by pressing or pulling it into engagement with a slots 61 across the top of a connector member 18, and retained there until fully installed with tool 90. Once fully installed, the gripping force of the lipped slots 61 provide an effective strain relief so that if wires are pulled or bumped after installation the connection with the connector member 18 is not disturbed.

With a wire or wires properly positioned in slots 61, 62 and 63 of one or more subhousings, tool 90 is inserted into the end of a subhousing, as facilitated by the subhousings relatively large funnel shaped ends 17. As the tool 90 moves into the subhousing, the funnel shape aids in axially aligning the tool 90 with respect to the connecting member 18, so that the tool 90 engages the wire and pushes it into the wire receiving slot 33 or 34. The trimming blade 34 or 40 of a connector member 18 severs the excess length of wire and as the wire slides in the slot 33 or 34 such that the insulation of the wire is pierced and displaced by the inside edges of a respective 33 or 34 slot in order to make an intimate electrical contact and a mechanical connection with the connecting member 18, as illustrated in FIG. 2. The excess length of wire sheared off by cutting edge 34 or 40 may be easily removed manually. As explained above, trimming residue may travel up the inside of tip 92 of tool 90 and out aperture 101. Also, it shall be seen that tool 90 pushes the wire further into lipped slot 61 so that the wire extends substantially transversely from the subhousing when installed.

Figure 7:
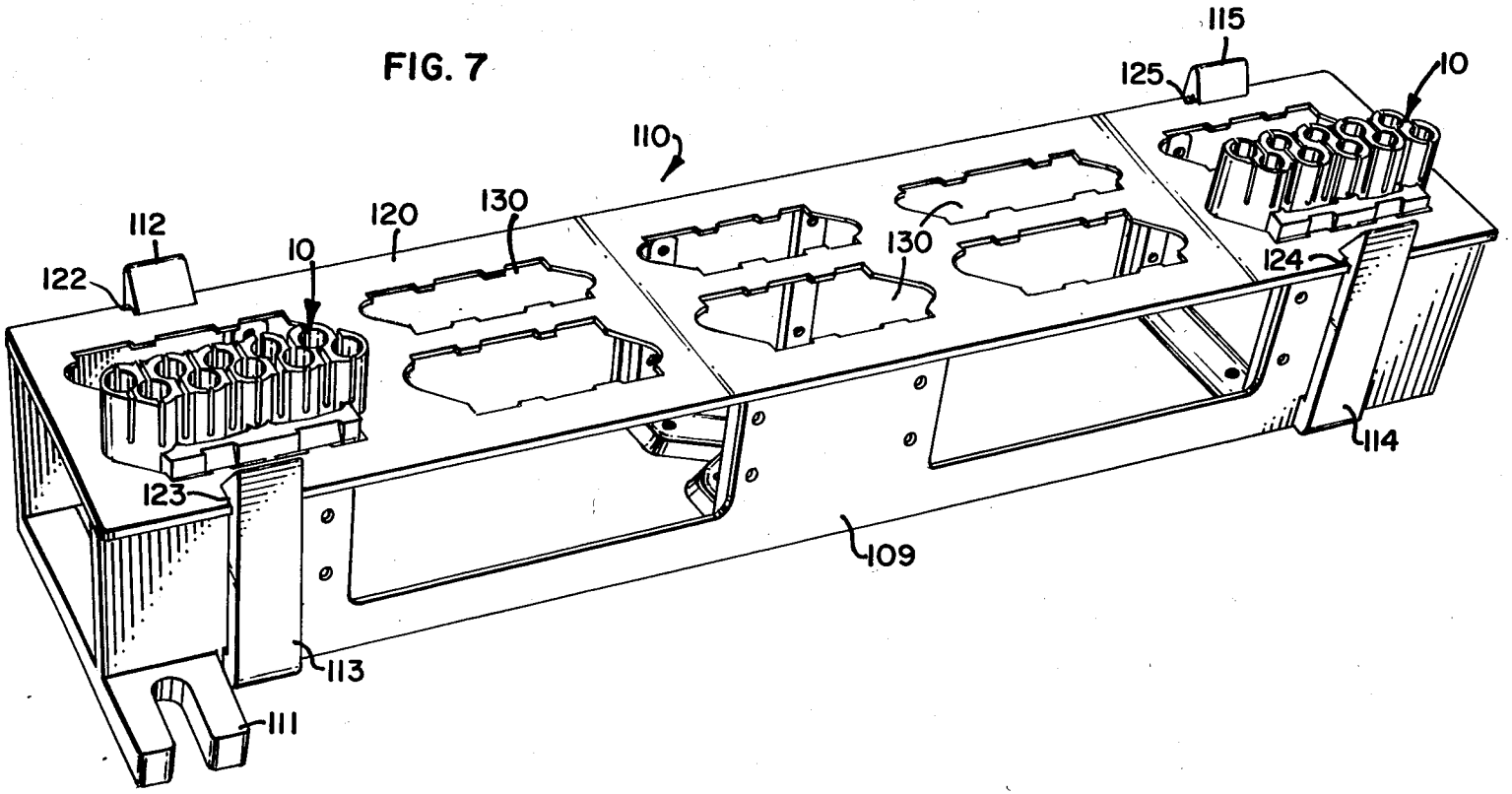
FIG. 7 is a perspective view of apparatus for mounting a plurality of connector modules according to the present invention.

Referring to FIG. 7 there is shown apparatus for mounting a connector panel 110 in a spaced relationship with a supporting surface. A mounting bracket 109 is provided, and includes a flange 111 and a further flange on the opposite corner thereof (not shown) by which bracket 110 may be mounted to a supporting surface, which is most usually vertical. Four resilient tab detent members 112–115 extend from near the bottom of the sidewall of bracket 109 to provide for the removable mounting of connector panel 110 to the bracket 109. Preferably, bracket 109 is an industry standard 89 bracket, which includes, as shown, a plurality of mounting holes by which further apparatus may be mounted, for example in-line cable terminals.

Connector panel 110 includes a metal plate panel member 120 sized for mounting to bracket 109, with member 120 preferably including cutaway recesses 122–125 to provide for retension of panel member 120 with respect to its longitudinal axis. Member 120 includes a plurality of apertures 130 sized for snap mounting of connector modules 10 as described above with respect to modules 10 and panel member 11. Although only shown with two modules 10 mounted thereto, panel member 120 would ordinarily be configured with a full compliment of modules.

Fully configured, the connector panel 110 may be used, for example, to terminate a pair of 25-wire cables, one in each row of modules 10, and for cross-connection of wire pairs between cables. For this purpose, a first side of connector panel 110 is used to terminate the cables, with the other side used for the cross-connection. To this end the first side can initially be positioned face-up and the cables terminated in the connector modules 10. Next, connector panel 110 can be flipped and snapped into place in bracket 109, with the cables thus extending from the open ends of the bracket 109. Cross-connection may then be easily accomplished on the other upwardly facing side. And, because modules 10 are function-wise symmetrical, wire insertion on either side of the panel 110 may be accomplished using a single tool, which uncomplicates wire installation and correspondingly increases installer efficiency. Of course, the removable mounting of connector panel 110 on bracket 109 permits the panel to be easily demounted, facilitating inspection or rewiring of the cable termination side. Panel 110 may also be used, for example, to provide cross-connection fan-out for a single cable, as will be readily apparent to those skilled in the art. Of course, the above-examples merely illustrate a couple of the numerous uses to which a connector panel 110 may be put.

Figure 8:
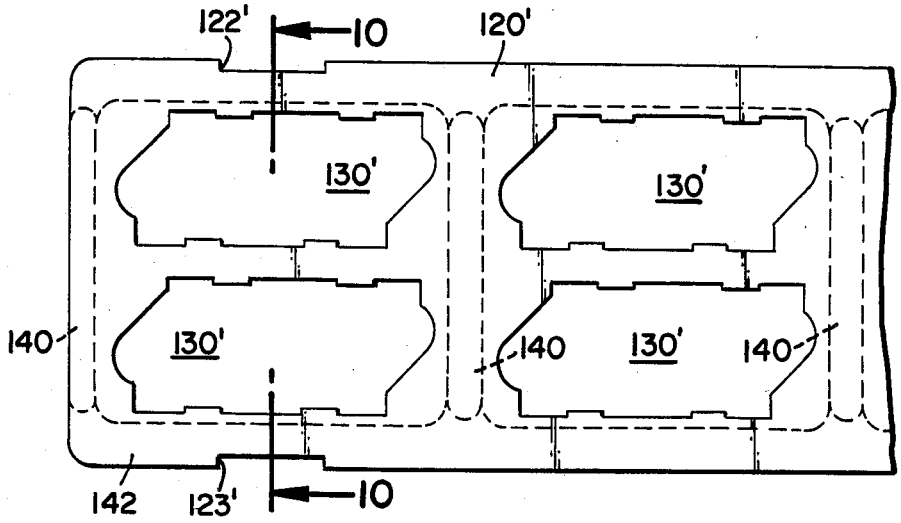
FIGS. 8, 9 and 10 are various views of a mounting panel for the connector modules according to the present invention.
Figure 9:
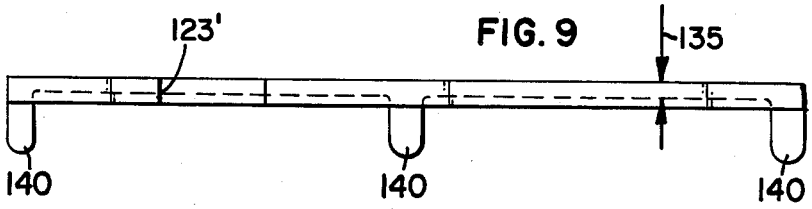
Figure 10:
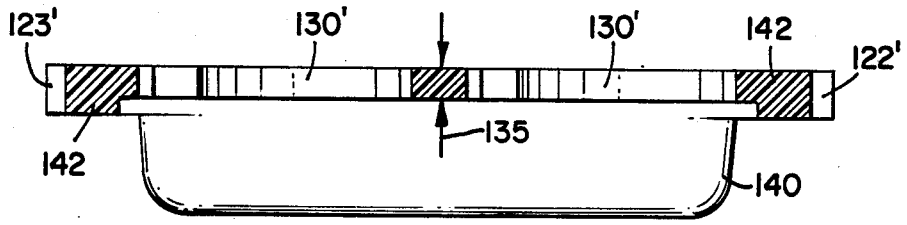

Alternatively to metal plate, panel member 120 may be constructed of plastic or any other suitably rigid material capable of supporting modules 10. FIGS. 8, 9 and 10 illustrate the structure of a plastic panel member 120' which may be used in place of metal member 120. Plastic panel member 120' is preferably injection molded to provide a substantially identical plan design to that of panel member 120. Panel member 120' includes apertures 130' and cutouts 122' and 123' which correspond to the like numbered elements of FIG. 7. Only an end portion of member 120' is shown for the sake of brevity in the drawing. However, it shall be understood that the unshown portion of member 120' is constructed in the same fashion.

As best seen with respect to the end view of FIG. 9 and the cross-sectional view of FIG. 10 (taken along the lines of 10—10 of FIG. 8) the portion of panel member 120' around the perimeter of apertures 130' has a fist thickness 135 sized to accommodate the snap mounting of modules 10 thereon, and a second greater thickness around its perimeter 142, which together with reinforcement ribs 140 provides structural rigidity.

Thus, it shall be seen then that the above-described connector module, connector panel, installation tool and method of installation provides that a plurality of wires may be secured in place for installation via the wire gripping slots in a single series of operations, and then fully installed in a series of installation operations such that switching back and forth between wire placement and installation with the wire installing tool is not required where two or more wires are sought to be installed sequentially. Also, it shall be seen that two or three wires may be installed in a given slot either sequentially or simultaneously. Moreover, it shall be seen that the installation tool of the present invention is completely symetrical such that the installation tool does not need to be oriented other than being axially aligned with a subhousing and connector member. Significant time savings in wire installation and savings in tool costs are thus accomplished. Still further, it shall be seen that construction of the housing 15 with a rigid plastic material in conjunction with the operation of the installation tool results in the absorbtion by the housing of most of the force applied via the tool, such that deformation or damage to the connector members 18 is avoided. Last, but not least, it shall be seen that the connector module of the present invention may be easily mounted on a panel 11 in a snap in fashion, and that the connector panel 110 may also be quickly mounted and demounted on bracket 109, facilating the installation, inspection and rewiring of wires.

Although the present invention has been described herein in its preferred form, those skilled in the art will readily appreciate that various modifications may be made thereto without departing from the spirit and scope of the invention as set forth in the claims appended hereto.

I claim:

1. Electrical connector apparatus for providing electrical connection for a plurality of insulated wires of a predetermined size comprising:

a plurality of metal split cylinder means each for receiving and engaging an insulated wire to form an electrical connection;

a non-conductive housing of unitary construction configured to provide a plurality of integrally formed, closely packed cylindrical subhousings each for concentrically supporting one of said split cylinder means, each of said subhousings including slots on diametrically opposed sides with one of said subhousing slots coaxially extending with a wire engaging slot in said split cylinder means;

said subhousings aligned in two closely adjacent rows with said subhousing slots aligned transversely to said rows and with contiguous subhousings in opposing rows having common insulating wall portions, the subhousings in each row laterally spaced apart in close proximity to form a plurality of intersubhousing slots each sized to receive one of said wires therein; and the subhousings in different rows laterally offset so that said slots on diametrically opposed sides of each subhousing are aligned in communication with one of said intersubhousing slots to define a complete wire receiving slot for each subhousing with opposing surfaces of said wire receiving slot spaced apart a distance sized to receive one of said insulated wires; and each of said wire receiving slots including strain relief means for retaining one of said insulated wires inserted within said wire receiving slot whereby wires to be connected may be laid side by side in said wire receiving slots before being inserted in said split cylinder means.

2. Electrical connector apparatus according to claim 1 wherein said strain relief means comprises a pair of opposing lips protruding into said one of said subhousing slots coaxially extending with the wire engaging slot in said split cylinder means to pinch and grip the insulation of an inserted wire.

3. Electrical connector apparatus according to claim 1 wherein opposing surfaces of subhousings within a same row are generally parallel and transverse to said row with said opposing parallel surfaces defining said intersubhousing slots.

4. Electrical connector apparatus for providing electrical connection for a plurality of insulated wires of a predetermined size comprising:

a plurality of metal split cylinder means each for receiving and engaging an insulated wire to form an electrical connection;

a non-conductive housing of unitary construction configured to provide a plurality of integrally formed, closely packed cylindrical subhousings each for concentrically supporting one of said split cylinder means, each of said subhousings including slots on diametrically opposed sides with one of said subhousing slots coaxially extending with a wire engaging slot in said split cylinder means;

said subhousingss aligned in two closely adjacent rows with said subhousing slots aligned transversely to said rows and with contiguous subhousings in opposing rows having common insulating wall portions, the subhousings in each row laterally spaced apart in close proximity to form a plurality of intersubhousing slots each sized to receive one of said wires therein;

and the subhousings in different rows laterally offset so that said slots on diametrically opposed sides of each subhousing are aligned in communication with one of said intersubhousing slots to define a complete wire receiving slot for each subhousing with opposing surfaces of said wire receiving slots spaced apart a distance sized to receive one of said insulated wires; and each of said wire receiving slots including strain relief means for retaining one of said wires inserted within a wire receiving slot whereby wires to be connected may be laid side by side in said wire receiving slots before being inserted in said split cylinder means;

panel means for supporting said housing with one end of said housing accessible on each side of said panel means; and bracket means for demountably supporting said panel means in a spaced relationship with a bracket supporting surface.

5. Electrical connector apparatus according to claim 4 wherein said strain relief means comprises a pair of opposing lips protruding into said one of said subhousing slots coaxially extending with the wire engaging slot in said split cylinder means to pinch and grip the insulation of an inserted wire.

6. Electrical connector apparatus according to claim 4 wherein opposing surfaces of subhousings within a same row are generally parallel and transverse to said row with said opposing parallel surfaces defining said intersubhousing slots.

7. Electrical connector apparatus for providing electrical connection for a plurality of insulated wires of a predetermined size comprising:

a non-conductive housing of unitary construction having a plurality of integrally formed subhousings with said subhousings aligned in narrowly spaced apart offset honeycomb fashion in two rows with opposing surfaces of subhousings in a row defining a plurality of intersubhousing slots extending through said row and with opposing offset subhousings sharing a common wall portion;

said subhousings having diametrically opposed slots with diametrically opposed slots of subhousings in one row aligned in communication with intersubhousing slots of the other rows; said aligned slots cooperating to define a complete wire receiving slot for each subhousing with opposing surfaces of said wire receiving slot spaced apart sufficient to receive said insulated wire; and said wire receiving slot including strain relief means for retaining one of said insulated wires inserted therein;

a plurality of metal split cylinder means each for receiving and engaging an insulated wire to form an electrical connection, said cylinder means disposed within said subhousings with the wire engaging slot of said cylinder means aligned in communication with one of said diametrically opposed slots.

8. Electrical connector apparatus according to claim 7 wherein said strain relief means comprises a pair of opposing protruding lips, one lip extending from each side of the one of said diametrically opposed slots aligned in communication with said wire engaging slot of said split cylinder means, said lips spaced apart so that said lips pinch and grip the insulation of an inserted wire.

9. Electrical connector apparatus according to claim 7 wherein said opposing surface of said subhousing defining said intersubhousing slots are generally flat parallel surfaces having a length approximately equal to a length of said split cylinder means wire engaging slot.

10. Electrical connector apparatus for providing electrical connection for a plurality of insulated wires of a predetermined size comprising:

a plurality of metal split cylinder means each having a first end and an axially disposed second end with each of said first and second ends having means for receiving and engaging an insulated wire to form an electrical connection;

a non-conductive housing configured to provide a plurality of inegrally formed, closely packed cylindrical subhousings each for concentrically supporting one of said split cylinder means; each of said subhousings having first ends and second ends with said first ends of said subhousings having slots on diametrically opposed sides with one of said slots coaxially extending with a wire receiving slot in said first ends of said split cylinder means; said second ends of said subhousings having slots on diametrically opposed sides with one of said slots coaxially extending with a wire receiving slot in said second ends of said split cylinder means;

said subhousings aligned in two closely adjacent parallel rows with said subhousing slots aligned transversely to said rows, the subhousings in each row laterally spaced apart with opposing surfaces defining a plurality of intersubhousing slots each sized to receive said wire of predetermined size lying transverse to said rows and subhousings in different rows laterally offset so that said slots of each subhousing are aligned in communication with one of said intersubhousing slots to form a complete wire receiving slot for each subhousing; and each of said wire receiving slots for said subhousings including strain relief means for retaining one of said wires within said slots.

11. Electrical connector apparatus according to claim 10 comprising:

a panel for supporting said housing with said first ends of said subhousings accessible on one side of said panel and with said second ends of said subhousings accessible on another side of said panel;

said panel having an aperture sized to receive said housing with said subhousings generally normal to said aperture;

said housing having a plurality of flexible bridge members supported on said housing and spaced therefrom and aligned to oppose a plurality of tabs protruding into said aperture and rigidly secured to said panel; said tabs sized to engage a surface of said bridge members as said housing is urged into said aperture with said tabs flexing said bridge members and said bridge members flexing back after said bridge members have passed said tabs.

12. Electrical connector apparatus according to claim 1 wherein said cylindrical subhousings are provided with frustoconical inside surface portions coaxially aligned with a cylindrical axis of said subhousings and with a base end of said frustoconical surface disposed at an end of said subhousings, whereby a funnel shaped guide is formed to facilitate the insertion and alignment of an insertion tool.

13. Electrical connector apparatus according to claim 4 wherein said cylindrical subhousings are provided with frustconical inside surface portions coaxially aligned with a cylindrical axis of said subhousings and with a base end of said frustconical surface disposed at an end of said subhousings, whereby a funnel shaped guide is formed to facilitate the insertion and alignment of an insertion tool.

14. Electrical connector apparatus according to claim 7 wherein the inside surfaces of the ends of said subhousings are funnel shaped so that the insertion and alignment of an insertion tool is facilitated.

15. Electrical connector apparatus according to claim 10 wherein said interior surface of cylindrical subhousings are funnel shaped for receiving a tool and directing said tool to be in alignment with said subhousings and said split cylinder means.

* * * * *

UNITED STATES PATENT AND TRADEMARK OFFICE

CERTIFICATE OF CORRECTION

PATENT NO. : 4,688,872

DATED : August 25, 1987

INVENTOR(S) : Karl H. Pohl

It is certified that error appears in the above-identified patent and that said Letters Patent is hereby corrected as shown below:

Column 1, line 36, "discloses insulation" should be --discloses an insulation--;

Column 1, line 41, "conected" should be --connected--;

Column 1, line 42, "slic" should be --slide--;

Column 1, line 48, "crosssection" should be --cross-section--;

Column 4, line 53, "accomodate" should be --accommodate--;

Column 5, line 19, "then" should be --than--;

Column 6, line 49, "with a slots 61" should be --with slots 61--;

UNITED STATES PATENT AND TRADEMARK OFFICE

CERTIFICATE OF CORRECTION

PATENT NO. : 4,688,872

DATED : August 25, 1987

INVENTOR(S) : Karl H. Pohl

It is certified that error appears in the above-identified patent and that said Letters Patent is hereby corrected as shown below:

Column 8, line 9, "fist" should be --first--;

Column 8, line 27, "symetrical" should be --symmetrical--;

Column 8, line 34, "absorbtion" should be --absorption--;

Column 9, line 42, "subhousingss" should be --subhousings--;

In the Abstract, line 25, "abuting" should read --abutting--.

Signed and Sealed this

Nineteenth Day of January, 1988

*Attest:*

DONALD J. QUIGG

*Attesting Officer*

*Commissioner of Patents and Trademarks*